US009038748B2

(12) United States Patent
Radford et al.

(10) Patent No.: US 9,038,748 B2
(45) Date of Patent: May 26, 2015

(54) TOOLS FOR USE IN SUBTERRANEAN BOREHOLES HAVING EXPANDABLE MEMBERS AND RELATED METHODS

(75) Inventors: Steven R. Radford, The Woodlands, TX (US); Khoi Q. Trinh, Pearland, TX (US); S. Richard Gentry, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 633 days.

(21) Appl. No.: 13/291,785

(22) Filed: Nov. 8, 2011

(65) Prior Publication Data

US 2012/0111579 A1 May 10, 2012

Related U.S. Application Data

(60) Provisional application No. 61/411,201, filed on Nov. 8, 2010.

(51) Int. Cl.

| | |
|---|---|
| ***E21B 10/32*** | (2006.01) |
| ***E21B 7/28*** | (2006.01) |
| ***E21B 23/00*** | (2006.01) |

(52) U.S. Cl.

CPC ..... *E21B 10/322* (2013.01); *E21B 7/28* (2013.01); *E21B 23/00* (2013.01)

(58) Field of Classification Search

CPC ..... E21B 7/00; E21B 10/322; E21B 10/32; E21B 7/28; E21B 23/00

USPC ..... 175/57, 267, 269, 277, 280, 290, 291, 175/406

See application file for complete search history.

(56) References Cited

U.S. PATENT DOCUMENTS

| | | | |
|---|---|---|---|
| 1,678,075 | A | 7/1928 | Phipps |
| 2,069,482 | A | 2/1937 | Seay |
| 2,177,721 | A | 10/1939 | Johnson et al. |
| 2,344,598 | A | 3/1944 | Church |
| 2,754,089 | A | 7/1956 | Kammerer, Jr. |
| 2,758,819 | A | 8/1956 | Kammerer, Jr. |
| 2,834,578 | A | 5/1958 | Carr |

(Continued)

FOREIGN PATENT DOCUMENTS

| | | | |
|---|---|---|---|
| EP | 246789 | A2 | 11/1987 |
| EP | 1036913 | A1 | 9/2000 |

(Continued)

OTHER PUBLICATIONS

International Search Report for International Application No. PCT/US2011/059781 dated Jun. 1, 2012, 3 pages.

(Continued)

*Primary Examiner* — David Andrews
*Assistant Examiner* — Kristyn Hall
(74) *Attorney, Agent, or Firm* — TraskBritt

(57) ABSTRACT

Expandable apparatus for use in subterranean boreholes include at least one member configured to move between a retracted position and an extended position. A latching member disposed in the tubular body may selectively retain the at least one member in the retracted position. Methods of operating an expandable apparatus include securing at least one member of the expandable apparatus in a retracted position by engaging an inner wall of a tubular body with at least one latch member disposed in at least one aperture formed in a latch sleeve.

18 Claims, 6 Drawing Sheets

(56) References Cited

U.S. PATENT DOCUMENTS

| | | | | |
|---|---|---|---|---|
| 2,882,019 | A | | 4/1959 | Carr et al. |
| 3,105,562 | A | | 10/1963 | Stone et al. |
| 3,123,162 | A | | 3/1964 | Rowley |
| 3,126,065 | A | | 3/1964 | Chadderdon |
| 3,211,232 | A | | 10/1965 | Grimmer |
| 3,224,507 | A | | 12/1965 | Cordary et al. |
| 3,425,500 | A | | 2/1969 | Fuchs |
| 3,433,313 | A | | 3/1969 | Brown |
| 3,556,233 | A | | 1/1971 | Gilreath |
| 4,091,883 | A | | 5/1978 | Weber |
| 4,282,941 | A | | 8/1981 | Perkin |
| 4,282,942 | A | | 8/1981 | Longmore |
| 4,403,659 | A | | 9/1983 | Upchurch |
| 4,407,377 | A | | 10/1983 | Russell |
| 4,431,065 | A | | 2/1984 | Andrews |
| 4,458,761 | A | | 7/1984 | Van Vreeswyk |
| 4,545,441 | A | | 10/1985 | Williamson |
| 4,589,504 | A | | 5/1986 | Simpson |
| 4,635,738 | A | | 1/1987 | Schillinger et al. |
| 4,660,657 | A | | 4/1987 | Furse et al. |
| 4,690,229 | A | | 9/1987 | Raney |
| 4,693,328 | A | | 9/1987 | Furse et al. |
| 4,711,326 | A | | 12/1987 | Baugh et al. |
| 4,842,083 | A | | 6/1989 | Raney |
| 4,848,490 | A | | 7/1989 | Anderson |
| 4,854,403 | A | | 8/1989 | Ostertag et al. |
| 4,884,477 | A | | 12/1989 | Smith et al. |
| 4,889,197 | A | | 12/1989 | Boe |
| 5,139,098 | A | | 8/1992 | Blake |
| 5,175,429 | A | | 12/1992 | Hall et al. |
| 5,201,817 | A | | 4/1993 | Hailey |
| 5,211,241 | A | | 5/1993 | Mashaw et al. |
| 5,224,558 | A | | 7/1993 | Lee |
| 5,265,684 | A | | 11/1993 | Rosenhauch |
| 5,275,239 | A | * | 1/1994 | Obrejanu ..... 166/210 |
| 5,293,945 | A | | 3/1994 | Rosenhauch et al. |
| 5,305,833 | A | | 4/1994 | Collins |
| 5,318,131 | A | | 6/1994 | Baker |
| 5,318,137 | A | | 6/1994 | Johnson et al. |
| 5,318,138 | A | | 6/1994 | Dewey et al. |
| 5,332,048 | A | | 7/1994 | Underwood et al. |
| 5,343,963 | A | | 9/1994 | Bouldin et al. |
| 5,361,859 | A | | 11/1994 | Tibbitts |
| 5,368,114 | A | | 11/1994 | Tandberg et al. |
| 5,375,662 | A | | 12/1994 | Echols, III et al. |
| 5,402,856 | A | | 4/1995 | Warren |
| 5,425,423 | A | | 6/1995 | Dobson et al. |
| 5,437,308 | A | | 8/1995 | Morin et al. |
| 5,495,899 | A | | 3/1996 | Pastusek |
| 5,553,678 | A | | 9/1996 | Barr et al. |
| 5,740,864 | A | | 4/1998 | de Hoedt et al. |
| 5,788,000 | A | | 8/1998 | Maury et al. |
| 5,823,254 | A | | 10/1998 | Dobson et al. |
| 5,853,054 | A | | 12/1998 | McGarian |
| 5,887,655 | A | | 3/1999 | Haugen et al. |
| 5,957,223 | A | | 9/1999 | Doster et al. |
| 6,039,131 | A | | 3/2000 | Beaton |
| 6,059,051 | A | | 5/2000 | Jewkes et al. |
| RE36,817 | E | | 8/2000 | Pastusek |
| 6,109,354 | A | | 8/2000 | Ringgenberg et al. |
| 6,116,336 | A | | 9/2000 | Adkins et al. |
| 6,131,675 | A | | 10/2000 | Anderson |
| 6,142,248 | A | | 11/2000 | Thigpen et al. |
| 6,189,631 | B1 | | 2/2001 | Sheshtawy |
| 6,213,226 | B1 | | 4/2001 | Eppink et al. |
| 6,227,312 | B1 | | 5/2001 | Eppink et al. |
| 6,289,999 | B1 | | 9/2001 | Dewey et al. |
| 6,325,151 | B1 | | 12/2001 | Vincent et al. |
| 6,360,831 | B1 | | 3/2002 | Akesson et al. |
| 6,378,632 | B1 | | 4/2002 | Dewey |
| 6,488,104 | B1 | | 12/2002 | Eppink et al. |
| 6,494,272 | B1 | | 12/2002 | Eppink et al. |
| 6,615,933 | B1 | | 9/2003 | Eddison |
| 6,668,936 | B2 | | 12/2003 | Williamson, Jr. et al. |
| 6,668,949 | B1 | | 12/2003 | Rives |
| 6,708,785 | B1 | | 3/2004 | Russell et al. |
| 6,732,817 | B2 | | 5/2004 | Dewey |
| 6,880,650 | B2 | | 4/2005 | Hoffmaster et al. |
| 7,036,611 | B2 | | 5/2006 | Radford et al. |
| 7,048,078 | B2 | | 5/2006 | Dewey et al. |
| 7,252,163 | B2 | | 8/2007 | Ollerenshaw et al. |
| 7,308,937 | B2 | | 12/2007 | Radford et al. |
| 7,314,099 | B2 | | 1/2008 | Dewey et al. |
| 7,493,971 | B2 | | 2/2009 | Nevlud et al. |
| 7,513,318 | B2 | | 4/2009 | Underwood et al. |
| 7,549,485 | B2 | | 6/2009 | Radford et al. |
| 2002/0070052 | A1 | | 6/2002 | Armell |
| 2003/0029644 | A1 | | 2/2003 | Hoffmaster et al. |
| 2005/0205305 | A1 | | 9/2005 | Stout et al. |
| 2007/0089912 | A1 | | 4/2007 | Eddison |
| 2008/0102175 | A1 | | 5/2008 | Jeon et al. |
| 2008/0105464 | A1 | | 5/2008 | Radford |
| 2008/0105465 | A1 | | 5/2008 | Radford |
| 2008/0110678 | A1 | | 5/2008 | Radford et al. |
| 2008/0128169 | A1 | | 6/2008 | Radford |
| 2008/0128174 | A1 | | 6/2008 | Radford et al. |
| 2008/0128175 | A1 | * | 6/2008 | Radford et al. ..... 175/269 |
| 2010/0025116 | A1 | | 2/2010 | Hutton |
| 2011/0073330 | A1 | | 3/2011 | Radford |
| 2011/0284233 | A1 | | 11/2011 | Wu et al. |

FOREIGN PATENT DOCUMENTS

| | | | |
|---|---|---|---|
| GB | 2328964 | A | 3/1999 |
| GB | 2344607 | A | 6/2000 |
| GB | 2344122 | B | 4/2003 |
| WO | 9928587 | A1 | 6/1999 |
| WO | 0031371 | A1 | 6/2000 |
| WO | 2004097163 | A1 | 11/2004 |
| WO | 2008070038 | A1 | 6/2008 |

OTHER PUBLICATIONS

International Written Opinion for International Application No. PCT/US2011/059781 dated Jun. 1, 2012, 3 pages.

Radford et al., Novel Concentric Expandable Stabilizer Results in Increased Penetration Rates and Drilling Efficiency with Reduced Vibration, SPE/IADC Drilling Conference and Exhibition, Mar. 17-19, 2009, Amsterdam, The Netherlands, 13 pages.

International Preliminary Report on Patentability for International Application No. PCT/US2011/059781 dated May 14, 2013.

* cited by examiner

TOOLS FOR USE IN SUBTERRANEAN BOREHOLES HAVING EXPANDABLE MEMBERS AND RELATED METHODS

CROSS REFERENCE TO RELATED APPLICATION

This application claims the benefit of U.S. Provisional Patent Application Ser. No. 61/411,201, filed Nov. 8, 2010, entitled "Earth-Boring Tools Having Expandable Members and Related Methods," the disclosure of which is incorporated herein by reference in its entirety.

TECHNICAL FIELD

Embodiments of the present disclosure relate generally to an expandable apparatus for use in a subterranean borehole and, more particularly, to an expandable reamer apparatus for enlarging a subterranean borehole and to an expandable stabilizer apparatus for stabilizing a bottom home assembly during a drilling operation and to related methods.

BACKGROUND

Expandable reamers are typically employed for enlarging subterranean boreholes. Conventionally, in drilling oil, gas, and geothermal wells, casing is installed and cemented to prevent the well bore walls from caving into the subterranean borehole while providing requisite shoring for subsequent drilling operation to achieve greater depths. Casing is also conventionally installed to isolate different formations, to prevent cross-flow of formation fluids, and to enable control of formation fluids and pressure as the borehole is drilled. To increase the depth of a previously drilled borehole, new casing is laid within and extended below the previous casing. While adding additional casing allows a borehole to reach greater depths, it has the disadvantage of narrowing the borehole. Narrowing the borehole restricts the diameter of any subsequent sections of the well because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, which is assigned to the assignee of the present disclosure. A bi-center bit assembly employs two longitudinally superimposed bit sections with laterally offset axes, which, when rotated, produce an enlarged borehole diameter. An example of a bi-center bit is disclosed in U.S. Pat. No. 5,957,223, which is also assigned to the assignee of the present disclosure.

Another conventional approach used to enlarge a subterranean borehole includes employing an extended bottom hole assembly with a pilot drill bit at the distal end thereof and a reamer assembly some distance above the pilot drill bit. This arrangement permits the use of any conventional rotary drill bit type (e.g., a rock bit or a drag bit), as the pilot bit and the extended nature of the assembly permit greater flexibility when passing through tight spots in the borehole as well as the opportunity to effectively stabilize the pilot drill bit so that the pilot drill bit and the following reamer will traverse the path intended for the borehole. This aspect of an extended bottom hole assembly is particularly significant in directional drilling. The assignee of the present disclosure has, to this end, designed as reaming structures so called "reamer wings," which generally comprise a tubular body having a fishing neck with a threaded connection at the top thereof and a tong die surface at the bottom thereof, also with a threaded connection. U.S. Pat. Nos. RE 36,817 and 5,495,899, both of which are assigned to the assignee of the present disclosure, disclose reaming structures including reamer wings. The upper midportion of the reamer wing tool includes one or more longitudinally extending blades projecting generally radially outwardly from the tubular body, and PDC cutting elements are provided on the blades.

As mentioned above, conventional expandable reamers may be used to enlarge a subterranean borehole and may include blades that are pivotably or hingedly affixed to a tubular body and actuated by way of a piston disposed therein as disclosed by, for example, U.S. Pat. No. 5,402,856 to Warren. In addition, U.S. Pat. No. 6,360,831 to Akesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string, and, once the tool has passed beyond the end of the casing, the blades are extended so the bore diameter may be increased below the casing.

BRIEF SUMMARY

In some embodiments, the present disclosure includes an expandable apparatus for use in a subterranean borehole. The expandable apparatus includes a tubular body having a longitudinal bore and at least one opening in a wall of the tubular body. At least one member is positioned within the at least one opening in the wall of the tubular body and configured to move between a retracted position and an extended position. A sleeve member is disposed in the tubular body and has a longitudinal bore forming a fluid passageway through the sleeve member to allow fluid to flow therethrough. The sleeve member includes a retaining portion exhibiting a width that is greater than a width of an adjacent portion of the sleeve member. A latch sleeve has at least one aperture formed therein and at least one latch member at least partially disposed within the at least one aperture. The retaining portion of the sleeve member selectively retains the at least one latch member in engagement with a portion of the tubular body to retain the at least one member in the retracted position.

In additional embodiments, the present disclosure includes an expandable apparatus for use in a subterranean borehole. The expandable apparatus includes a tubular body having a longitudinal bore and at least one opening in a wall of the tubular body. At least one member is positioned within the at least one opening in the wall of the tubular body and configured to move between a retracted position and an extended position. A sleeve member is disposed in the tubular body and has a longitudinal bore forming a fluid passageway through the sleeve member to allow fluid to flow therethrough. The sleeve member includes an enlarged portion sized and configured to selectively retain at least one slidable latch member within the tubular body in engagement with a portion of the tubular body to retain the at least one member in the retracted position.

In yet additional embodiments, the present disclosure includes a method for operating an expandable apparatus for use in a subterranean borehole. The method includes securing at least one member of the expandable apparatus in a retracted position comprising engaging an inner wall of a tubular body of an expandable apparatus with at least one latch member disposed in at least one aperture formed in a latch sleeve, disengaging the at least one latch member from the inner wall of the tubular body of the expandable apparatus, and moving the at least one member of the expandable apparatus from the retracted position to an extended position.

BRIEF DESCRIPTION OF THE DRAWINGS

While the specification concludes with claims particularly pointing out and distinctly claiming what are regarded as embodiments of the disclosure, various features and advantages of embodiments of the disclosure may be more readily ascertained from the following description of some embodiments of the disclosure, when read in conjunction with the accompanying drawings, in which:

DETAILED DESCRIPTION

The illustrations presented herein are, in some instances, not actual views of any particular earth-boring tool, expandable apparatus, cutting element, or other feature of an earth-boring tool, but are merely idealized representations that are employed to describe embodiments the present disclosure. Additionally, elements common between figures may retain the same numerical designation.

As used herein, the terms "distal" and "proximal" are relative tell is used to describe portions of an expandable apparatus or members thereof with reference to a borehole being drilled. For example, a "distal" portion of an expandable apparatus is the portion in closer relative proximity to the downhole portion of the borehole (e.g., relatively closer to the furthest extent of the borehole and the furthest extent of a drill string extending into the borehole) when the expandable apparatus is disposed in a wellbore extending into a formation during a drilling or reaming operation. A "proximal" portion of an expandable apparatus is the portion in closer relative proximity to the uphole portion of the borehole (e.g., relatively more distant from the furthest extent of the borehole and the furthest extent of a drill string extending into the borehole) when the expandable apparatus is disposed in a wellbore extending into the formation during a drilling or reaming operation.

In some embodiments, the expandable apparatus described herein may be similar to the expandable apparatus described in, for example, United States Patent Application Publication No. US2008/0128175 A1, which application was filed Dec. 3, 2007 and entitled "Expandable Reamers for Earth-Boring Applications" and U.S. patent application Ser. No. 12/894,937, which application was filed Sep. 30, 2010, now U.S. Pat. No. 8,727,041, issued May 20, 2014, and entitled "Earth-Boring Tools having Expandable Members and Related Methods," the disclosure of each of which is incorporated herein in its entirety by this reference.

Figure 1:
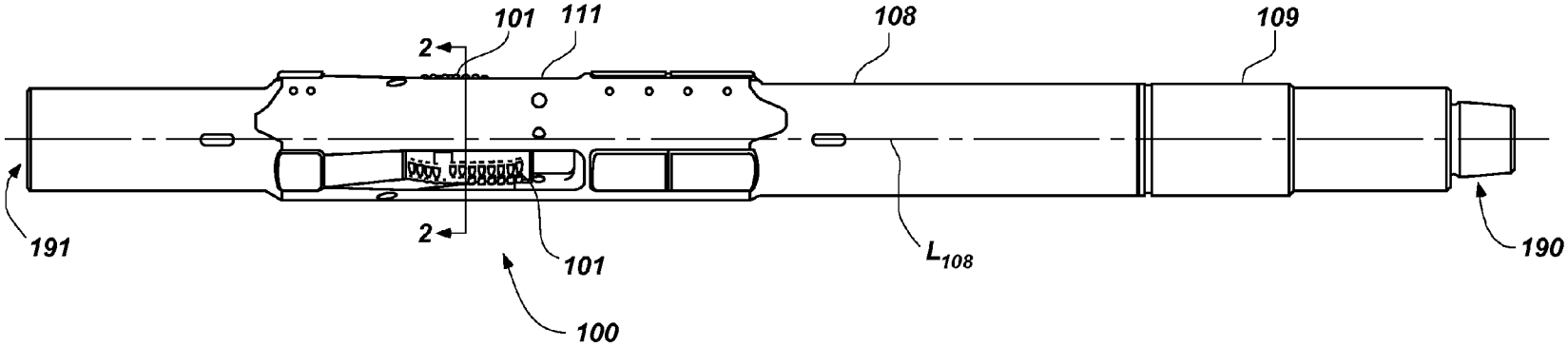
FIG. 1 is a side view of an embodiment of an expandable reamer apparatus in accordance with an embodiment of the present disclosure.

An embodiment of an expandable apparatus (e.g., an expandable reamer apparatus 100) of the disclosure is shown in FIG. 1. The expandable reamer apparatus 100 may include a generally cylindrical tubular body 108 having a longitudinal axis $L_{108}$. The tubular body 108 of the expandable reamer apparatus 100 may have a distal end 190, a proximal end 191, and an outer surface 111. The distal end 190 of the tubular body 108 of the expandable reamer apparatus 100 may include a set of threads (e.g., a threaded male pin member) for connecting the distal end 190 to another section of a drill string or another component of a bottom-hole assembly (BHA), such as, for example, a drill collar or collars carrying a pilot drill bit for drilling a well bore. In some embodiments, the expandable reamer apparatus 100 may include a lower sub 109 that connects to the lower box connection of the tubular body 108. Similarly, the proximal end 191 of the tubular body 108 of the expandable reamer apparatus 100 may include a set of threads (e.g., a threaded female box member) for connecting the proximal end 191 to another section of a drill string or another component of a bottom-hole assembly (BHA). It is noted that while the embodiment of FIG. 1 illustrates an expandable reamer apparatus 100 carrying blades 101, the expandable apparatus may comprises other apparatus such as, for example, an expandable stabilizer apparatus carrying stabilizer blocks thereon for stabilizing a drilling assembly during a drilling operation.

Figure 3:
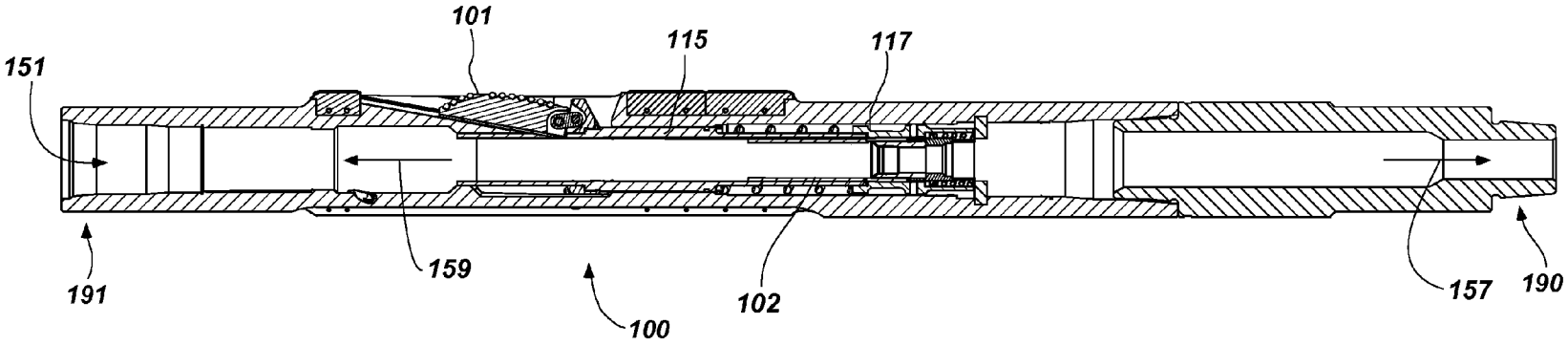
FIG. 3 shows a longitudinal cross-sectional view of the expandable reamer apparatus as indicated by section line 3-3 in FIG. 2.
Figure 6:
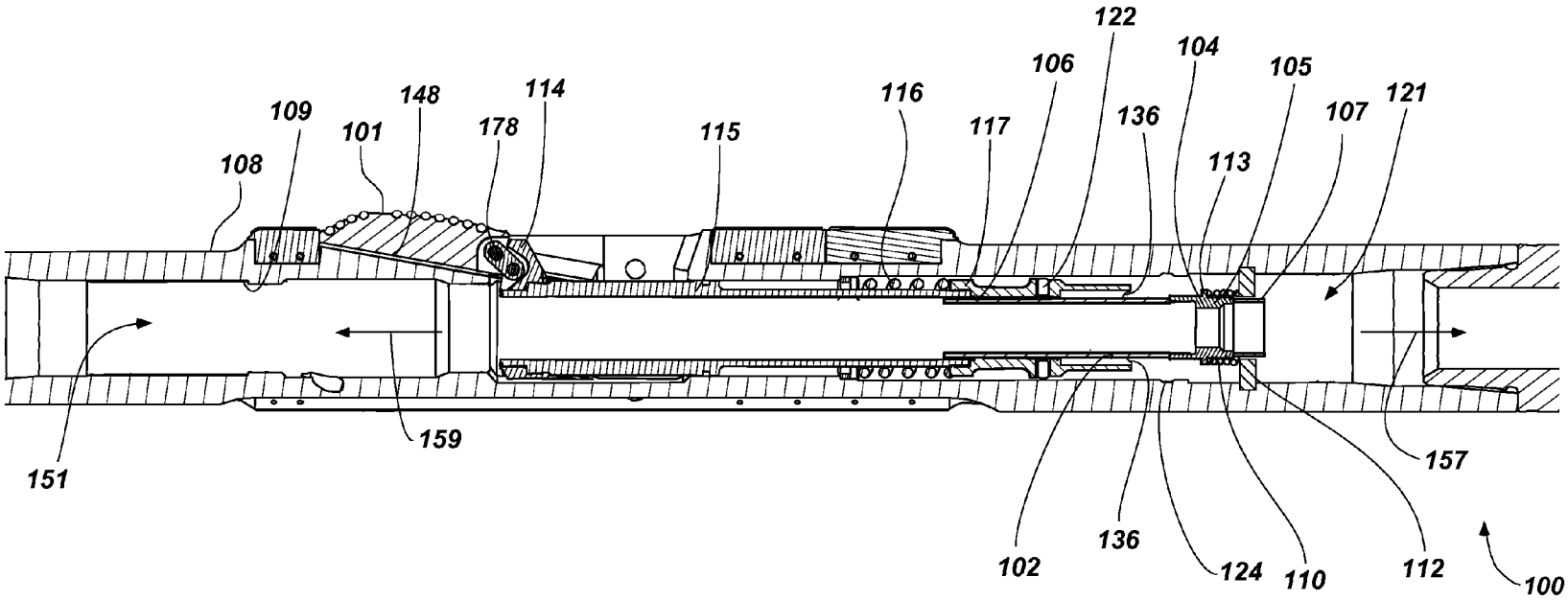
FIG. 6 shows a partial, longitudinal cross-sectional illustration of an embodiment of an expandable reamer apparatus in an expanded position.

Three sliding members (e.g., blades 101, stabilizer blocks, etc.) are retained in circumferentially spaced relationship in the tubular body 108 as further described below and may be provided at a position along the expandable reamer apparatus 100 intermediate the first distal end 190 and the second proximal end 191. The blades 101 may be comprised of steel, tungsten carbide, a particle-matrix composite material (e.g., hard particles dispersed throughout a metal matrix material), or other suitable materials as known in the art. The blades 101 are retained in an initial, retracted position within the tubular body 108 of the expandable reamer apparatus 100, as illustrated in FIG. 3, but may be moved responsive to application of hydraulic pressure into the extended position, as illustrated in FIG. 6, and returned to the retracted position when desired, as will be described herein. The expandable reamer apparatus 100 may be configured such that the blades 101 engage the walls of a subterranean formation surrounding a well bore in which expandable reamer apparatus 100 is disposed to remove formation material when the blades 101 are in the extended position, but are not operable to engage the walls of a subterranean formation within a well bore when the blades 101 are in the retracted position. While the expandable reamer apparatus 100 includes three blades 101, it is contemplated that one, two or more than three blades may be utilized to advantage. Moreover, while the blades 101 of expandable reamer apparatus 100 are symmetrically circumferentially positioned about the longitudinal axis $L_{108}$ along the tubular body 108, the blades may also be positioned circumferentially asymmetrically as well as asymmetrically about the longitudinal axis $L_{108}$. The expandable reamer apparatus 100 may also include a plurality of stabilizer pads to stabilize the tubular body 108 of expandable reamer apparatus 100 during drilling or reaming processes. For example, the expandable reamer apparatus 100 may include upper hard face pads, mid hard face pads, and lower hard face pads.

Figure 2:
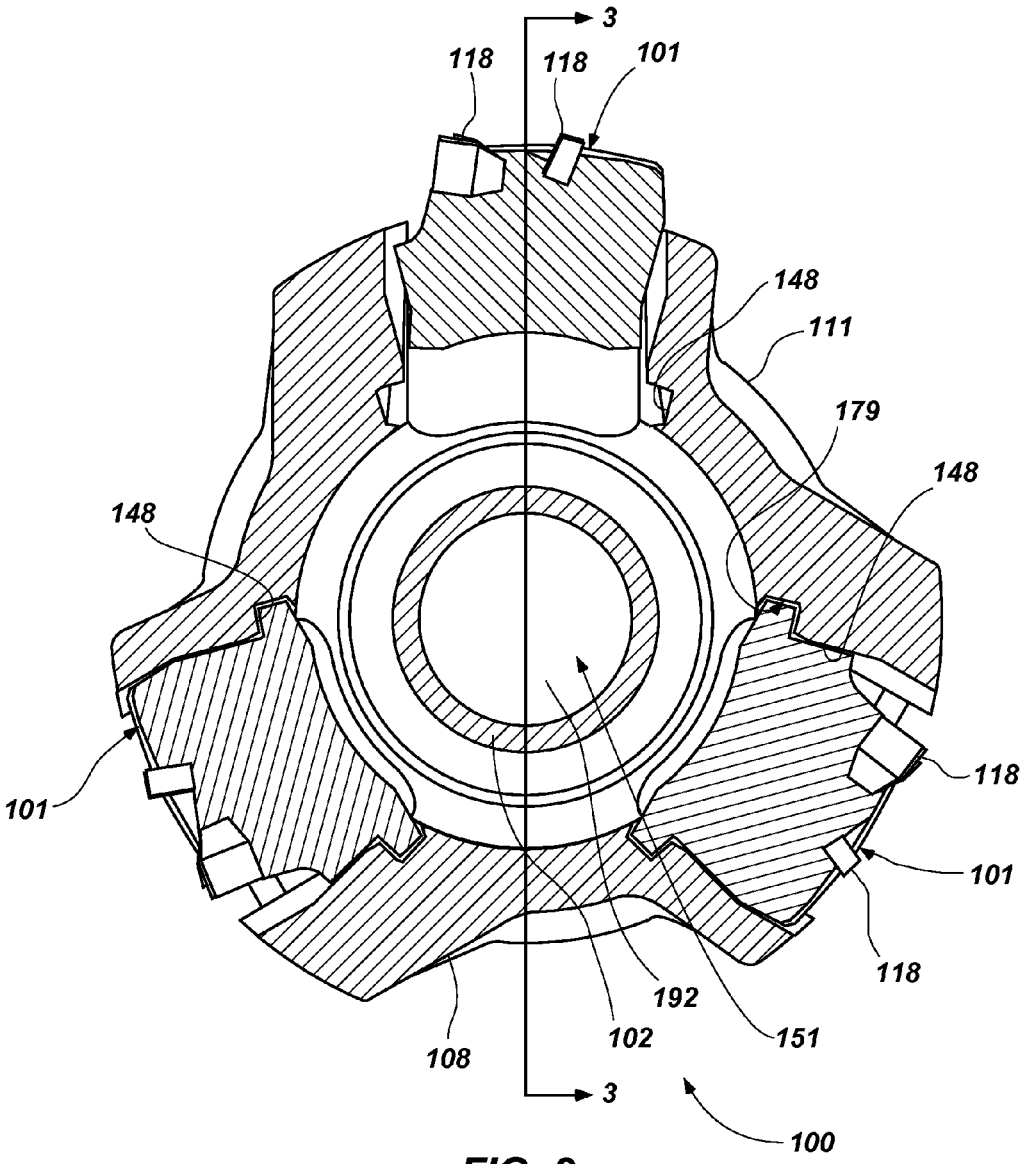
FIG. 2 shows a transverse cross-sectional view of the expandable reamer apparatus as indicated by section line 2-2 in FIG. 1.

FIG. 2 is a cross-sectional view of the expandable reamer apparatus 100 shown in FIG. 1 taken along section line 2-2 shown therein. As shown in FIG. 2, the elongated cylindrical wall of the tubular body 108 encloses a fluid passageway 192 that extends longitudinally through the tubular body 108. Fluid may travel through the fluid passageway 192 in a longitudinal bore 151 of the tubular body 108 (and a longitudinal bore of a sleeve member) in a bypassing relationship to substantially shield the blades 101 from exposure to drilling fluid, particularly in the lateral direction, or normal to the longitudinal axis $L_{108}$. The particulate-entrained fluid is less likely to cause build-up or interfere with the operational aspects of the expandable reamer apparatus 100 by shielding the blades 101 from exposure with the fluid. However, it is recognized that shielding of the blades 101 is not necessary to the operation of the expandable reamer apparatus 100 where, as explained in further detail below, the operation (i.e., extension from the initial position, the extended position and the retracted position) occurs by an axially directed force that is the net effect of the fluid pressure and spring biases forces. The axially directed force may actuate the blades 101 by axially influencing an actuating feature, such as a push sleeve 115 (shown in FIG. 3) for example, and without limitation, as described herein below.

Referring still to FIG. 2, to better describe aspects of embodiments of the disclosure, one of blades 101 is shown in the outward or extended position while the other blades 101 are shown in the initial or retracted positions. The expandable reamer apparatus 100 may be configured such that the outermost radial or lateral extent of each of the blades 101 is recessed within the tubular body 108 when in the initial or retracted positions so as to not extend beyond the greatest extent of outer diameter of the tubular body 108. Such an arrangement may protect the blades 101 as the expandable reamer apparatus 100 is disposed within a casing of a borehole, and may enable the expandable reamer apparatus 100 to pass through such casing within a borehole. In other embodiments, the outermost radial extent of the blades 101 may coincide with or slightly extend beyond the outer diameter of the tubular body 108. The blades 101 may extend beyond the outer diameter of the tubular body 108 when in the extended position, for example, to engage the walls of a borehole in a reaming operation.

The three sliding blades 101 may be retained in three blade tracks 148 formed in the tubular body 108. The blades 101 each carry a plurality of cutting elements 118 for engaging the material of a subterranean formation defining the wall of an open borehole when the blades 101 are in an extended position (shown in FIG. 3). The cutting elements 118 may be polycrystalline diamond compact (PDC) cutters or other cutting elements known in the art.

Optionally, one or more of the blades 101 may be replaced with stabilizer blocks having guides and rails as described herein for being received into grooves 179 of the track 148 in the expandable reamer apparatus 100, which may be used as expandable concentric stabilizer rather than a reamer, which may further be utilized in a drill string with other concentric reamers or eccentric reamers.

FIG. 3 shows a longitudinal cross-sectional view of the expandable reamer apparatus as indicated by section line 3-3 in FIG. 2. The expandable reamer apparatus 100 may include an actuating feature, such as a push sleeve 115 coupled to extendable and retractable blades 101. The actuating feature of the reamer apparatus 100 may also include a latch sleeve 117 coupled to the push sleeve 115. In some embodiments, the latch sleeve 117 may be formed as a portion of the push sleeve 115. The push sleeve may be directly or indirectly coupled (e.g., by a linkage) to the one or more blades 101 of the expandable reamer apparatus 100. As discussed below in further detail, the push sleeve 115 may move in the uphole direction 159 in order to transition the blades 101 between the extended and retracted position. The blades 101 of the expandable reamer apparatus 100 may be retained in a retracted position by a retaining feature such as a sleeve member (e.g., a traveling sleeve 102).

Figure 4:
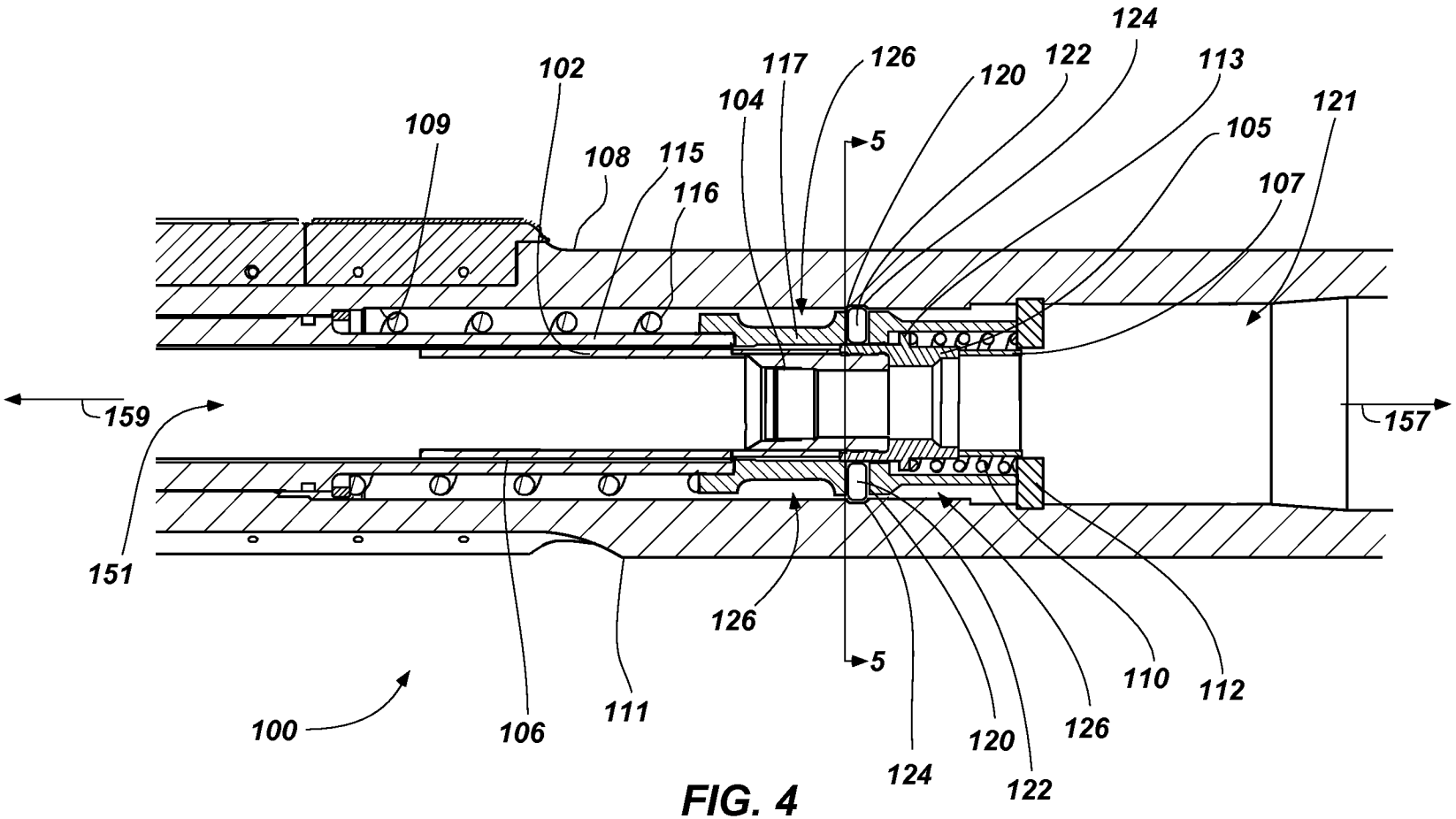
FIG. 4 shows an enlarged cross-sectional view of a portion of the expandable reamer apparatus shown in FIG. 3.

As shown in FIG. 4, the expandable reamer apparatus 100 may include a traveling sleeve 102 that is movable from a first, initial position, which is shown in FIG. 4, in the downhole direction 157 to a second position shown in FIG. 6. In some embodiments, the traveling sleeve 102 may form a constricted portion of the longitudinal bore 151 of the expandable reamer apparatus 100. For example, the traveling sleeve 102 may be disposed within the longitudinal bore 151 of the expandable reamer apparatus 100. At relatively lower fluid flow rates of the drilling fluid through the longitudinal bore 151, the traveling sleeve 102 may allow fluid to pass therethrough. However, at a relatively higher fluid flow rate, the traveling sleeve 102 may start to limit the amount of fluid passing through the traveling sleeve 102. The constriction of the fluid flow through the fluid passageway formed in the longitudinal bore 151 of the expandable reamer apparatus 100 by a constriction portion 104 of the traveling sleeve 102 may cause an increased hydraulic pressure proximate to the traveling sleeve 102. It is noted that while the embodiment of FIG. 4 illustrates the traveling sleeve having a constriction portion 104 at a middle portion thereof, in additional embodiments, the constriction portion may be formed in the traveling sleeve at any suitable location. For example, as shown in FIG. 6, the constriction portion 104 may be located at an end portion (e.g., the downhole portion 121 or distal end) of the traveling sleeve 102. In other embodiments, the traveling sleeve 102 may be configured to receive an external actuation device (e.g., a ball) to constrict or occlude fluid flow through the longitudinal bore 151 of the expandable reamer apparatus 100.

The increased pressure at a proximal end of the constriction portion 104 of the traveling sleeve 102 and a decreased pressure at a distal end of the constriction portion 104 of the traveling sleeve 102 may form a pressure differential and may impart a force in the downhole direction 157 to the traveling sleeve 102. The force may translate the traveling sleeve 102 in the downhole direction 157. In some embodiments, the fluid flow path in the longitudinal bore 151 of the tubular body 108 in a downhole direction 157 from the constriction portion 104 of the traveling sleeve 102 (e.g., the downhole portion 121) may comprise a cross-sectional area or diameter greater than the cross-sectional area or diameter of the constriction portion 104 to increase the pressure differential between the proximal end of the constriction portion 104 and the distal end of the constriction portion 104. In additional embodiments, other methods may be used to constrict fluid flow through the traveling sleeve 102 in order to move the traveling sleeve 102 in the downhole direction 157. For example, an obstruction may be selectively disposed within the traveling sleeve 102 to at least partially occlude fluid from flowing therethrough in order to apply a force in the downhole direction 157 to the traveling sleeve 102.

The traveling sleeve 102 may be at least partially received within a portion of the actuating feature of the reamer apparatus 100 (e.g., one or more of a portion of the push sleeve 115 and a portion of the latch sleeve 117). For example, the push sleeve 115 and the latch sleeve 117 may be retained between the traveling sleeve 102 and an inner wall 109 of the tubular body 108 of the expandable reamer apparatus 100.

The push sleeve 115 may be retained in the initial position by the traveling sleeve 102. For example, a portion of the traveling sleeve 102 may act to secure a portion of the push sleeve 115 (or another component attached thereto such as, for example, the latch sleeve 117) to a portion of the inner wall 109 of the tubular body 108 of the expandable reamer apparatus 100. For example, the latch sleeve 117 may be coupled to the push sleeve 115 and may include one or more latch members 122 for engaging the inner wall 109 of the tubular body 108. The latch sleeve 117 may include one or more apertures 120 (e.g., apertures 120 extending laterally through the latch sleeve 117 relative to the longitudinal axis $L_{108}$ (FIG. 1) of the tubular body 108) having one or more latch members 122 disposed therein. The latch members 122 disposed in the apertures 120 may be movable therein. For example, the latch members 122 may slidably translate in a substantially lateral direction relative to the longitudinal axis $L_{108}$ (FIG. 1) of the tubular body 108 between an extended position (as shown in FIG. 6) and a retracted position (as shown in FIG. 4). It is noted that while the embodiment of FIG. 4 illustrates slidable latch members 122, in additional embodiments, the latch members may move between an extended position and a retracted position in any suitable manner. For example, one or more latch members may be partially coupled (e.g., pinned) within the apertures and may rotate between extended position and a retracted position. In some embodiments, the push sleeve may also be biased in the initial position (e.g., by a spring 116).

In some embodiments, the latch sleeve 117 may have one or more recesses 126 (e.g., recesses extending along the length of the latch sleeve 117) formed therein to allow fluid to flow around the latch sleeve 117 (e.g., between the inner wall 109 of the tubular body 108 and the latch sleeve 117).

Figure 5:
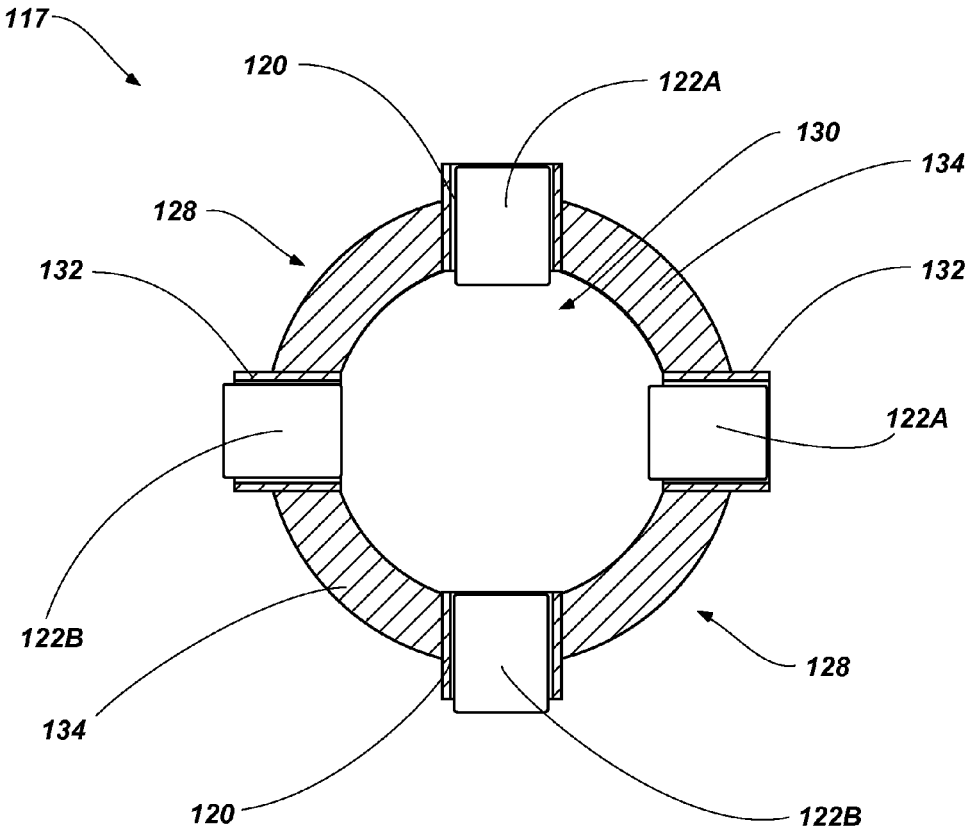
FIG. 5 shows a cross-sectional view of a latch sleeve for use with an embodiment of an expandable apparatus in accordance with the present disclosure such as the expandable apparatus shown in FIG. 1 and as indicated by section line 5-5 in FIG. 4.

FIG. 5 shows a cross-sectional view of the latch sleeve 117 as indicated by section line 5-5 in FIG. 4. As shown in FIG. 5, the latch sleeve 117 includes latch members 122 that are translatable in the apertures 120 of the latch sleeve 117. By way of example, two latch members 122A are shown in a retracted position and two latch members 122B are shown in an expanded position. In some embodiments, one or more recesses 128 (e.g., recesses extending around a circumference of the latch sleeve 117) may be formed in the latch sleeve 117 to allow fluid to flow around the latch sleeve 117 (e.g., between the inner wall 109 of the tubular body 108 and the latch sleeve 117) and may be in communication with the recesses 126 (FIG. 4). For example, the latch sleeve 117 may include extended portions 132 that form the apertures 120 for the latch members 122 and that are configured to extend substantially to, as shown in FIG. 4, the inner wall 109 of the tubular body 108 when the latch sleeve 117 is disposed in the tubular body 108. The latch sleeve 117 may also include recessed portions 134 between the extended portions 132 that are configured to be offset from the inner wall 109 of the tubular body 108 when the latch sleeve 117 is disposed in the tubular body 108 to form the recesses 126.

The latch sleeve 117 may include a longitudinal bore 130 formed therein and a portion of the traveling sleeve 102 (FIG. 4) may be received in the longitudinal bore 130.

Referring back to FIG. 4, when the traveling sleeve 102 is in the initial position, the hydraulic pressure may act on the push sleeve 115, which is coupled the latch sleeve 117, between an outer surface of the traveling sleeve 102 and an inner surface of the tubular body 108. With or without hydraulic pressure, when the expandable reamer apparatus 100 is in the initial position, the push sleeve 115 is prevented from moving (e.g., in the uphole direction 159) by the latch members 122 of the latch sleeve 117. The latch members 122 may be retained between one or more grooves 124 (e.g., an annular groove) formed in the longitudinal bore 151 of the tubular body 108 (e.g., formed in the inner wall 109) by the traveling sleeve 102. For example, the traveling sleeve 102 may include an enlarged or retaining portion such as, for example, a stopper portion 105 having a cross-sectional area (e.g., a cross-sectional area including the area of a longitudinal bore formed in the stopper portion 105) that is greater than a cross-sectional area of an adjacent portion of the traveling sleeve 102. By way of further example, the stopper portion 105 of the traveling sleeve 102 may exhibit a dimension such as, for example, a width (e.g., a dimension transverse to the longitudinal axis $L_{108}$ (FIG. 1)) or an outer diameter that is greater than a width or outer diameter of an adjacent portion of the traveling sleeve 102 (e.g., the constriction portion 104). Each latch member 122 may engage the groove 124 of the tubular body 108 when compressively engaged by the stopper portion 105 of the traveling sleeve 102. The latch members 122 may hold the latch sleeve 117, which may be coupled to or formed integrally with the push sleeve 115, in place and prevent the push sleeve 115 from moving in the uphole direction 159. When the stopper portion 105 of the traveling sleeve 102, with its larger outer diameter, travels beyond the latch members 122, the latch members 122 may retract radially inward toward the smaller outer diameter of the traveling sleeve 102 (e.g., the smaller outer diameter of an extended portion 106 of the traveling sleeve 102). When the latch members 122 retract radially inward and disengage from the groove 124 of the tubular body 108, the push sleeve 115 may be enabled to move responsive to hydraulic pressure primarily in the axial direction (e.g., in the uphole direction 159).

In some embodiments, the latch sleeve 117 may abut against a portion of the expandable reamer apparatus 100. For example, the latch sleeve 117 may abut against a ring 112 disposed in the tubular body 108 or a shoulder formed in the tubular body 108 when the latch sleeve 117 is an initial position being retained by the traveling sleeve 102.

After the traveling sleeve 102 travels sufficiently far enough from the initial position in the downhole direction 157 to enable the latch members 122 of the latch sleeve 117 to be disengaged from the groove 124 of the tubular body 108, the latch members 122 of the latch sleeve 117, which is coupled to the push sleeve 115, may all move in the uphole direction 159. In order for the push sleeve 115 to move in the uphole direction 159, the differential pressure between the longitudinal bore 151 and the outer surface 111 of the tubular body 108 caused by the hydraulic fluid flow must be sufficient to overcome the restoring force or bias of the spring 116.

A biasing element 110 such as, for example, a spring, may be used to bias the traveling sleeve 102 to the initial position. The biasing element 110 may be disposed in the longitudinal bore 151 of the expandable reamer apparatus 100. The biasing element 110 may abut against a portion of the traveling sleeve 102 and against a portion of the tubular body 108 to apply a force against the traveling sleeve 102 that urges the traveling sleeve 102 toward the initial position. For example, the biasing element 110 may abut against a portion of the tubular body 108 (e.g., the ring 112 disposed in the tubular body 108, a shoulder formed in the tubular body 108, etc.) and may abut against the traveling sleeve 102 at a shoulder 113 formed on a stopper portion 105 of the traveling sleeve 102. In some embodiments, the biasing element 110 may be coupled to a portion of the tubular body 108 or a portion of the traveling sleeve 102. In other embodiments, the biasing element 110 may be retained by a groove formed in the tubular body 108 or a groove formed in the traveling sleeve 102.

As the traveling sleeve 102 moves in the downhole direction 157, the stopper portion 105 of the traveling sleeve 102 may abut a portion of the ring 112 formed in the tubular body 108 and the ring 112 may inhibit the traveling sleeve 102 from moving beyond the ring 112. The traveling sleeve 102 may further include a guide portion 107 extending in a downhole direction 157 from the stopper portion 105. The guide portion 107 may be received within an orifice formed by the ring 112 of the tubular body 108 and may axially align and guide the movement of the traveling sleeve 102 in the downhole direction 157 within the tubular body 108.

An extended portion 106 of the traveling sleeve 102 may extend in a direction along the longitudinal bore 151 of the tubular body 108. The extended portion 106 may also extend along a portion of the push sleeve 115 and the latch sleeve 117 to prevent fluid flow from flowing through apertures 120 in the latch sleeve 117 when the push sleeve 115 and the latch sleeve 117 are displaced in the uphole direction 159.

Referring now to FIGS. 4 and 6, the expandable reaming apparatus 100 is now described in terms of its operational aspects. Before "triggering" the expandable reamer apparatus 100 to the expanded position, the expandable reamer apparatus 100 is maintained in an initial, retracted position as shown in FIG. 4. While the traveling sleeve 102 is biased in the initial position by the biasing element 110, the blade actuating feature (e.g., the push sleeve 115) is prevented from actuating the blades 101. The traveling sleeve 102 has, on its distal end, an enlarged end piece (e.g., the stopper portion 105). This larger diameter stopper portion 105 holds the latch members 122 of the latch sleeve 117 in a secured position, preventing the push sleeve 115 from moving upward under affects of differential pressure and activating the blades 101. The latch members 122 are at least partially disposed in the groove 124 in the longitudinal bore 151 of the tubular body 108. When it is desired to trigger the expandable reamer apparatus 100, the traveling sleeve 102 is moved in the downhole direction 157 to release the latch members 122 of the latch sleeve 117. For example, the rate of flow of drilling fluid through the reamer apparatus 100 is increased to increase the hydraulic pressure at the constriction portion 104 of the traveling sleeve 102 and to exert a force (e.g., a force due to a pressure differential) against the traveling sleeve 102 and translate the traveling sleeve 102 in the downhole direction 157.

As shown in FIG. 6, the traveling sleeve 102 may travel sufficiently far enough from the initial position in the downhole direction 157 to enable the latch members 122 of the latch sleeve 117 to be disengaged from the groove 124 of the tubular body 108. The latch sleeve 117 coupled to the pressure-activated push sleeve 115 may move in the uphole direction 159 under fluid pressure influence (e.g., from fluid supplied through orifices in one or more of the latch sleeve 117 (e.g., scallops 136), the traveling sleeve 102, and the ring 112). As the fluid pressure is increased by the increased fluid flow, the biasing force of the spring 116 is overcome enabling the push sleeve 115 to move in the uphole direction 159. Movement of the push sleeve 115 in the uphole direction 159 may move a yoke 114, which is attached to the blades 101 by pins and linkage 178 to the blades 101, in order to displace the blades 101 in the uphole direction 159. In moving in the uphole direction 159, the blades 101 each follow a ramp or track 148 to which they are mounted (e.g., via a type of modified square dovetail groove 179 (FIG. 2)).

After the traveling sleeve 102 moves in the downhole direction 157 against the force of the biasing element 110, the stopper portion 105 may abut the ring 112 of the tubular body 108. In other embodiments, the stopper portion 105 may not abut the ring 112 as movement of the traveling sleeve 102 may be stopped by the force of the biasing element 110 or the biasing element 110 itself.

As shown in FIG. 6, the latch sleeve 117 may include one or more recesses formed in a portion thereof to enable fluid flow around the latch sleeve 117 (e.g., between the longitudinal bore 151 of the expandable reamer apparatus 100 and a volume (e.g., cavity) between the latch sleeve 117 and the inner wall 109 of the tubular body 108). For example, the latch sleeve 117 may include scallops 136 formed in an end portion (e.g., one or more of a distal end and a proximal end) of the latch sleeve 117.

Whenever the flow rate of the drilling fluid passing through the traveling sleeve 102 is decreased below a selected flow rate value, the biasing element 110 may return the traveling sleeve 102 to the initial position shown in FIG. 4 under the biasing force of spring 116. As the traveling sleeve 102 returns to the initial position, the latch sleeve 117 and the latch members 122 may return to the initial position and the traveling sleeve 102 may again secure the latch members 122 in the groove 124 of the tubular body 108. The push sleeve 115 with the yoke 114 may also return to the initial position and the blades 101 may return to the retracted position. In some embodiments, as the latch sleeve 117 is being returned to the initial position (e.g., by the force of the spring 116), the latch members 122 (in a retracted position 122A (FIG. 5)) may abut an edge (e.g., a chamfered edge) of the stopper portion 105 of the traveling sleeve 102 and move the traveling sleeve 102 in the downward direction 157. After traveling a selected distance in the downhole direction 157, the force of the biasing element 110 may act to force the traveling sleeve 102 in the uphole direction 159. Movement of the traveling sleeve 102 in the uphole direction 159 by the biasing element 110 may act to force a lateral side portion of the stopper portion 105 into contact with the latch members 122, thereby, forcing the latch members in a lateral direction (e.g., to secure the latch members 122 in the groove 124 of the tubular body 108).

Whenever the flow rate of the drilling fluid passing through traveling sleeve 102 is elevated to or beyond a selected flow rate value, the traveling sleeve 102 may again move in the downhole direction 157 releasing the latch members 122 of the latch sleeve 117 as shown in FIG. 6. The push sleeve 115 with the yoke 114 and blades 101 may then move upward with the blades 101 following the tracks 148 to again ream the prescribed larger diameter in a borehole. In this manner, the expandable reamer apparatus 100 may move the blades 101 between the retracted position and the expanded position in a repetitive manner (e.g., an unlimited amount of times). The expandable reamer apparatus 100 may also enable drilling fluid to flow through the tubular body 108 and to exit the tubular body 108 through the distal end 190 (FIG. 3) after the blades 101 are expanded or retracted (e.g., after elements of the expandable reamer apparatus 100 are moved from the initial position).

Embodiments of the present disclosure may be particularly useful in providing an expandable apparatus having an actuation mechanism that may be repeatedly transitioned between an initial position where the blades or blocks of the expandable apparatus are held in a secured, retracted state and a triggered positioned where the blades or blocks of the expandable apparatus may be extended to an expanded state. For example, a sleeve member may be caused to move to the downhole position and the blades are initially extended, the blades may retract and the sleeve member will return to the initial position securing the blades in the retracted position. In such embodiments, for example, drilling with a pilot bit attached to the downhole end of the reamer apparatus may resume while drilling fluid is pumped through the reamer apparatus to the pilot bit without causing the blades to again move into the extended position (i.e., without reaming), as long as the flow rate is maintained below that required to move the sleeve member in the downhole direction. In other words, the drilling fluid may be caused to flow through the sleeve member at a flow rate below the flow rate required to move the sleeve member in the downhole direction and to unsecure the latch members of the latch sleeve while drilling a bore with a pilot bit attached to the reamer apparatus and while the blades are retracted.

While particular embodiments of the disclosure have been shown and described, numerous variations and other embodiments will occur to those skilled in the art. Accordingly, it is intended that the disclosure only be limited in terms of the appended claims and their legal equivalents.

What is claimed is:

1. An expandable apparatus for use in a subterranean borehole, comprising:

a tubular body having a longitudinal bore and at least one opening in a wall of the tubular body;

at least one member positioned within the at least one opening in the wall of the tubular body, the at least one member configured to move between a retracted position and an extended position;

a sleeve member disposed in the tubular body and having a longitudinal bore forming a fluid passageway through the sleeve member to allow fluid to flow therethrough, the sleeve member comprising a retaining portion exhibiting a width that is greater than a width of an adjacent portion of the sleeve member; and a latch sleeve having at least one aperture formed therein and at least one latch member at least partially disposed within the at least one aperture, wherein, in an initial position, the retaining portion of the sleeve member selectively retains the at least one latch member in engagement with a portion of the tubular body to retain the at least one member in the retracted position, and wherein, in a triggered position, the sleeve member enables a portion of the at least one latch member to move radially inward into the longitudinal bore extending through the latch sleeve to disengage the at least one latch member from the tubular body.

2. The expandable apparatus of claim 1, wherein the latch sleeve comprises a plurality of apertures formed therein and a plurality of latch members, each latch member of the plurality of latch members being disposed in an aperture of the plurality of apertures.

3. The expandable apparatus of claim 2, wherein each latch member of the plurality of latch members comprises a slidable latch member, each slidable latch member being movable within an aperture of the plurality of apertures formed in the latch sleeve in a direction substantially transverse to the longitudinal bore.

4. The expandable apparatus of claim 1, wherein the sleeve member comprises a constricted portion, the constricted portion forming a portion of the longitudinal bore having a cross-sectional area less than a cross-sectional area of an adjacent portion of the longitudinal bore, the constricted portion constricting the fluid passageway through the sleeve member to enable displacement of the sleeve member in a downhole direction responsive to a selected flow rate.

5. The expandable apparatus of claim 1, further comprising a push sleeve disposed within the longitudinal bore of the tubular body and coupled to the at least one member and to the latch sleeve, the push sleeve configured to move the at least one member from the retracted position to the extended position responsive to a flow rate of drilling fluid passing through the longitudinal bore and wherein the sleeve member is positioned at least partially within the push sleeve, the retaining portion of the sleeve member configured to secure the push sleeve and the latch sleeve from axial movement within the tubular body in the initial position.

6. The expandable apparatus of claim 5, wherein the sleeve member is configured to selectively retain the push sleeve in the initial position and to release the push sleeve when displaced in the downhole direction in the triggered position.

7. The expandable apparatus of claim 1, wherein the latch sleeve comprises at least one recess formed therein, the at least one recess enabling fluid flow around a portion of the latch sleeve.

8. The expandable apparatus of claim 1, wherein the sleeve member is biased in the initial position.

9. The expandable apparatus of claim 1, wherein the expandable apparatus comprises at least one of an expandable reamer apparatus and an expandable stabilizer apparatus.

10. An expandable apparatus for use in a subterranean borehole, comprising:

a tubular body having a longitudinal bore and at least one opening in a wall of the tubular body;

at least one member positioned within the at least one opening in the wall of the tubular body, the at least one member configured to move between a retracted position and an extended position;

at least one slidable latch member disposed within the tubular body; and a sleeve member disposed in the tubular body and having a longitudinal bore forming a fluid passageway through the sleeve member to allow fluid to flow therethrough, the sleeve member comprising an enlarged portion sized and configured to directly engage the at least one slidable latch member within the tubular body to force the at least one slidable latch member into engagement with a portion of the tubular body to retain the at least one member in the retracted position, wherein the at least one slidable latch member is configured to slidably translate along a substantially lateral direction relative to the longitudinal bore of the tubular body, and wherein displacement of the sleeve member enables the at least one slidable latch member to slidably translate radially inward along the substantially lateral direction to disengage the portion of the tubular body enabling the at least one member to move to the extended position.

11. The expandable apparatus of claim 10, wherein the at least one slidable latch member comprises a plurality of slidable latch members, each being disposed in one aperture of a plurality of apertures formed in a latch sleeve disposed in the tubular body.

12. A method for operating an expandable apparatus for use in a subterranean borehole, comprising:

securing at least one member of the expandable apparatus in a retracted position comprising engaging an inner wall of a tubular body of an expandable apparatus with at least one latch member disposed in at least one aperture formed in a latch sleeve;

slidably translating the at least one latch member within the at least one aperture in the latch sleeve radially inward toward a longitudinal bore extending through the latch sleeve to disengage the at least one latch member from the inner wall of the tubular body of the expandable apparatus; and moving the at least one member of the expandable apparatus from the retracted position to an extended position.

13. The method of claim 12, wherein securing at least one member of the expandable apparatus in a retracted position further comprises engaging the at least one latch member with an enlarged portion of a sleeve member at least partially disposed in the tubular body of the expandable apparatus.

14. The method of claim 13, wherein disengaging the at least one latch member from the inner wall of the tubular body of the expandable apparatus comprises releasing the at least one latch member from engagement with the enlarged portion of the sleeve member comprising moving the enlarged portion of the sleeve member in a downhole direction from a first position to a second position.

15. The method of claim 14, wherein moving the enlarged portion of the sleeve member in a downhole direction from a first position to a second position comprises:

forming a constriction in a fluid flow path extending through the sleeve member; and moving the sleeve member in the downhole direction responsive to an increase in pressure of a fluid within the sleeve member at the constriction in the fluid flow path.

16. The method of claim 15, further comprising biasing the sleeve member to return to the first position responsive to a decrease in the pressure of the fluid in the sleeve member.

17. The method of claim 13, further comprising reaming the borehole with at least one cutting element on the at least one member while the at least one member is in the extended position after moving the at least one member from the retracted position to the extended position.

18. The method of claim 17, further comprising:

decreasing the pressure of the fluid within the sleeve member to enable the at least one member to return to the retracted position from the extended position; and further drilling the borehole with a pilot bit while the at least one member is in the retracted position after reaming the borehole.

* * * * *